US011069315B2

(12) United States Patent
Hosaka

(10) Patent No.: US 11,069,315 B2
(45) Date of Patent: Jul. 20, 2021

(54) IMAGE PROCESSING DEVICE AND LIQUID CRYSTAL PROJECTOR

(71) Applicant: SEIKO EPSON CORPORATION, Tokyo (JP)

(72) Inventor: Hiroyuki Hosaka, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/910,366

(22) Filed: Jun. 24, 2020

(65) Prior Publication Data

US 2020/0410946 A1 Dec. 31, 2020

(30) Foreign Application Priority Data

Jun. 25, 2019 (JP) ..... JP2019-117222

(51) Int. Cl.
*G09G 3/36* (2006.01)

(52) U.S. Cl.
CPC ... *G09G 3/3648* (2013.01); *G09G 2320/0242* (2013.01); *G09G 2340/0428* (2013.01)

(58) Field of Classification Search
CPC .... G06F 3/0484; G06F 3/04845; G06F 3/147; G09G 3/3648; G09G 2320/0242; G09G 2340/0407; G09G 2340/0428
See application file for complete search history.

(56) References Cited

U.S. PATENT DOCUMENTS

2011/0234650 A1* 9/2011 Watanabe ..... G09G 5/399 345/690
2013/0083244 A1 4/2013 Hosaka et al.
2013/0088527 A1* 4/2013 Irie ..... G09G 3/3648 345/690
2017/0025084 A1 1/2017 Mizusako et al.
2017/0054879 A1 2/2017 Hosaka et al.

FOREIGN PATENT DOCUMENTS

JP 2012-155212 A 8/2012
JP 2015-138149 A 7/2015

* cited by examiner

*Primary Examiner* — Robert J Michaud
(74) *Attorney, Agent, or Firm* — Oliff PLC

(57) ABSTRACT

An image processing device that uses pixels displayed in a liquid crystal panel to display, across a plurality of fields, pixels constituting an image specified with image data includes, a temporary determining unit configured to, based on a gradation level specified for one pixel of a liquid crystal panel and a gradation level specified for another pixel adjacent to the one pixel in one field, make temporary determination on whether to correct the gradation level of at least one of the one pixel or the other pixel, and a cancellation unit configured to cancel the temporary determination when the gradation level specified for each of the one pixel and the gradation level specified for the other pixel are identical to a gradation level in a field that precedes, by a plurality of the fields, the one field.

4 Claims, 9 Drawing Sheets

IMAGE PROCESSING DEVICE AND LIQUID CRYSTAL PROJECTOR

The present application is based on, and claims priority from JP Application Serial Number 2019-117222, filed Jun. 25, 2019, the disclosure of which is hereby incorporated by reference herein in its entirety.

BACKGROUND

1. Technical Field

The present disclosure relates to an image processing device and a liquid crystal projector.

2. Related Art

As in recent years, a liquid crystal panel has been reduced in size and becoming high definition, thereby narrowing a gap between pixel electrodes, and making effects of an electric field generated between pixel electrodes adjacent to each other, that is, an electric field in a direction parallel to a substrate surface (lateral electric field) non-ignorable. Specifically, an alignment defect of a liquid crystal or domain is generated by the lateral electric field, and is visually recognized as a defect in display.

A technique such as, for example, the following has been proposed to suppress a defect in display due to a domain. That is, a technique has been proposed in which, in a case in which an electric field in a lateral direction increases, specifically, in a case in which a voltage according to image data supplied from a higher device such as a host device is applied to a pixel electrode of a liquid crystal panel, and when a difference between respective voltages applied to adjacent pixel electrodes is assumed to reach or exceed a threshold value, this difference between the voltages is corrected to be small. Note that, such correction is referred to as domain correction.

On the other hand, for a liquid crystal projector using a liquid crystal panel, a technique has been known in which a position of a pixel projected onto a screen or the like is shifted by a shift device, in order to increase resolution in a pseudo manner. Specifically, in this technique, a period for displaying one unit image is divided into a plurality of fields, and a position of a pixel to be projected is shifted for each field to give a sensory perception as though more pixels are projected than the number of pixels represented by a liquid crystal panel.

A technique has been proposed for suppressing domains due to a lateral field, when resolution is increased in a pseudo manner using such pixel shifting (see, for example, JP-A-2015-138149).

A pixel subjected to domain correction in a liquid crystal panel has a gradation level different from that specified in image data supplied from a higher device such as a host device, thus a so-called display contradiction occurs. In the technique described in JP-A-2015-138149, the domain correction is performed when it is assumed that the electric field in the lateral direction increases in the liquid crystal panel in each field, thereby making the display contradiction likely to occur.

SUMMARY

An image processing device according to an aspect of the present disclosure is an image processing device displaying image data of an image, which has predetermined resolution specified with the image data, over a plurality of fields by using a liquid crystal panel having resolution smaller than the predetermined resolution, the image processing device including a temporary determining unit configured to, based on a gradation level specified for one pixel of the liquid crystal panel and a gradation level specified for another pixel adjacent to the one pixel in one field, make temporary determination on whether to correct the gradation level of at least one of the one pixel and the other pixel, and a cancellation unit configured to cancel the temporary determination when the gradation level specified for the one pixel and the gradation level specified for the other pixel are determined to be identical to a gradation level in a field that precedes, by a plurality of fields, the one field.

DESCRIPTION OF EXEMPLARY EMBODIMENTS

An exemplary embodiment will be described below with reference to the accompanying figures. Note that, in each figure, a size and a scale of each unit is different from the actual size and the actual scale of each unit as appropriate. Moreover, the exemplary embodiment described below is a suitable specific example, and various technically preferable limitations are applied, but the scope of the disclosure is not limited to these modes unless it is specifically described in the following description to limit the disclosure.

Figure 1:
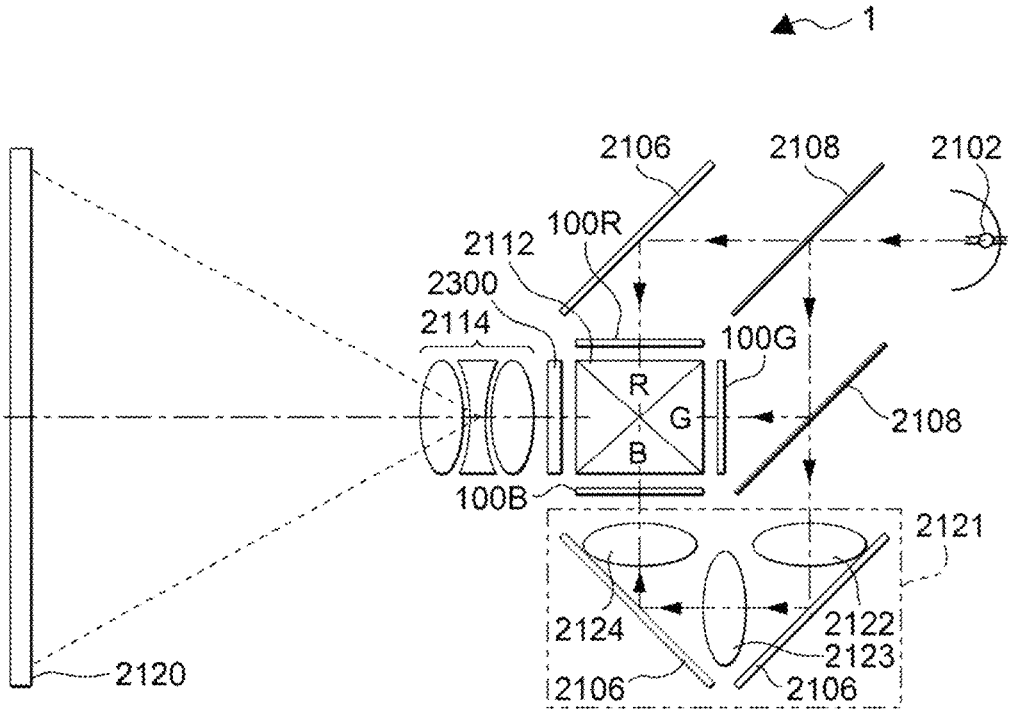
FIG. 1 is a diagram illustrating a liquid crystal projector according to an exemplary embodiment.

FIG. 1 is a diagram illustrating an optical configuration of a liquid crystal projector 1 including an image processing device according to the exemplary embodiment. As illustrated in the figure, the liquid crystal projector 1 includes liquid crystal panels 100R, 100G, and 100B. Additionally, a lamp unit 2102 including a white light source such as a halogen lamp is provided inside the liquid crystal projector 1. Projection light emitted from this lamp unit 2102 is split into three primary colors of red (R), green (G), and blue (B) by three mirrors 2106 and two dichroic mirrors 2108 installed inside. Of the light of the primary colors, light of R, light of G, and light of G are incident on the liquid crystal panel 100R, the liquid crystal panel 100G, and the liquid crystal panel 100B, respectively.

Note that, an optical path of B is longer than that of other red and green. Thus, the light of B is guided to the liquid crystal panel 100B via a relay lens system 2121 formed of an incidence lens 2122, a relay lens 2123, and an emission lens 2124 to prevent a loss due to the optical path.

The liquid crystal panel 100R includes pixel circuits arrayed in a matrix, and generates a transmitted image for R by light transmitted through a liquid crystal element of the above pixel circuit based on a data signal corresponding to R. Similarly, the liquid crystal panel 100G generates a transmitted image for G based on a data signal corresponding to G, and the liquid crystal panel 100B generates a transmitted image for B based on a data signal corresponding to B.

The transmitted image of each color generated by each of the liquid crystal panels 100R, 100G, and 100B is incident on a dichroic prism 2112 from three directions. Then, at this dichroic prism 2112, the light of R and the light of B are refracted at 90 degrees, whereas the light of G travels in a straight line. Thus, after the images of the respective colors are synthesized, the synthesized image is incident on a projection lens 2114 via a shift device 2300. The shift device 2300 shifts an optical axis in an emission direction from the dichroic prism 2112. Note that, a shifting operation by the shift device 2300 will be described later. The projection lens 2114 enlarges and projects the synthesized image transmitted through the shift device 2300 onto a screen 2120.

Note that, while the transmitted image by each of the liquid crystal panels 100R and 100B is projected after being reflected by the dichroic prism 2112, the transmitted image by the liquid crystal panel 100G travels in a straight line and is projected. Thus, the transmitted image by each of the liquid crystal panels 100R and 100B has a left-right inverted relationship with respect to the transmitted image by the liquid crystal panel 100G.

Figure 2:
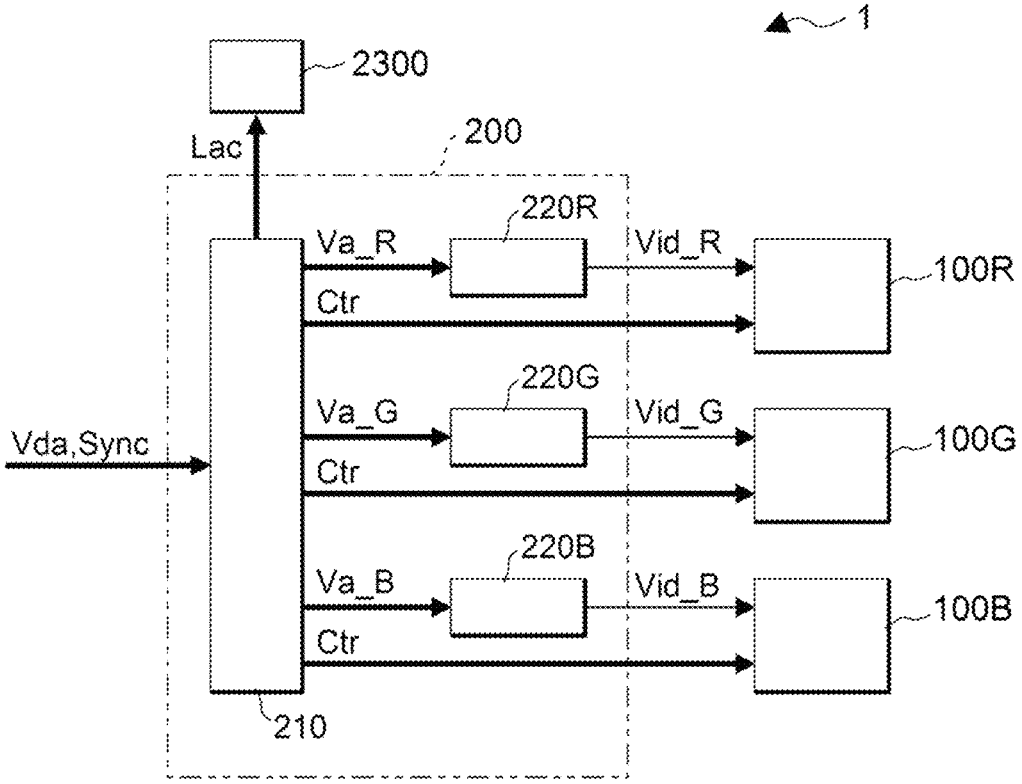
FIG. 2 is a block diagram illustrating a configuration of the liquid crystal projector.

FIG. 2 is a block diagram illustrating an electrical configuration of the liquid crystal projector 1. As illustrated in the figure, the liquid crystal projector 1 includes an image processing device 200, and the liquid crystal panels 100R, 100G, 100B, and the shift device 2300 described above.

Image data Vda is supplied synchronously with a synchronization signal Sync from a higher device such as a host device (not illustrated). The image data Vda specifies for each of R, G, and B, for example, using 8 bits, a gradation level of a pixel in an image to be displayed.

Note that, in the synthesized image of the liquid crystal panels 100R, 100G, and 100B, pixels are arrayed in a matrix in a vertical direction and in a horizontal direction. An array of pixels for which gradation levels are specified in the image data Vda is, for example, doubled in the vertical direction and doubled in the horizontal direction, as compared to the array of the pixels in the synthesized image of the liquid crystal panels 100R, 100G, and 100B.

Thus, in the present exemplary embodiment, a unit period (frame) for representing the image represented in the image data Vda is divided into, for example, four periods (fields). The shift device 2300 changes a position of a pixel projected onto the screen 2120 in each field, to increase resolution in the liquid crystal panels 100R, 100G, and 100B in a pseudo manner.

Note that, in the present exemplary embodiment, a color image projected onto the screen 2120 is represented by synthesizing, or superimposing the respective transmitted images of the liquid crystal panels 100R, 100G, and 100B. Thus, pixels that are smallest units of a color image may be divided into red sub-pixels by the liquid crystal panel 100R, green sub-pixels by the liquid crystal panel 100G, and blue sub-pixels by the liquid crystal panel 100B. However, when specification for color is not necessary for the sub-pixels in the liquid crystal panels 100R, 100G, and 100B, when only contrast matters, or the like, there is no need to intentionally denote as "sub-pixel". Thus, in the present description, display units in the liquid crystal panels 100R, 100G, and 100B are also referred to as pixels.

Further, the synchronization signal Sync includes a vertical synchronization signal indicating vertical scanning start of the image data Vda, a horizontal synchronization signal indicating horizontal scanning start, and a clock signal indicating timing for one pixel of the image data.

The image processing device 200 includes a display control circuit 210, processing circuits 220R, 220G, and 220B.

The display control circuit 210, firstly, decomposes the image data Vda supplied from the higher device and outputs the decomposed image data for each field and for each color. Specifically, the display control circuit 210 once accumulates the image data Vda from the higher device, reads image data that corresponds to a field, and is of R, out of the accumulated image data Vda, and outputs the image data as Va_R. The display control circuit 210 reads, out of the accumulated image data Vda, image data that corresponds to the field, and is of G, outputs the data as Va_G, and reads image data that corresponds to the field, and is of B, and outputs the image data as Va_B.

The display control circuit 210, secondly, supplies a control signal Ctr to the liquid crystal panels 100R, 100G, and 100B, for each field.

The display control circuit 210, thirdly, supplies a control signal Lac for controlling shift of an optical axis for each field to the shift device 2300.

Details of the processing circuits 220R, 220G, and 220B will be described later, however, when schematically described, the processing circuit 220R analyzes the image data Va_R, performs domain correction described later as appropriate and conversion to a data signal Vid_R having an analog voltage, and supplies the data signal to the liquid crystal panel 100R.

Similarly, the processing circuit 220G analyzes the image data Va_G, performs the domain correction as appropriate and conversion to a data signal Vid_G having an analog voltage, and supplies the data signal to the liquid crystal panel 100G. The processing circuit 220B analyzes the image data Va_B, performs the domain correction as appropriate and conversion to a data signal Vid_B having an analog voltage, and supplies the data signal to the liquid crystal panel 100B.

Next, the liquid crystal panels 100R, 100G, and 100B will be described. The liquid crystal panels 100R, 100G, and 100B only differ from each other in a color of incident light, that is a wavelength, and have common structure. Thus, the liquid crystal panels 100R, 100G, and 100B will be generally described without specifying a color, using a numeral sign 100.

Figure 3:
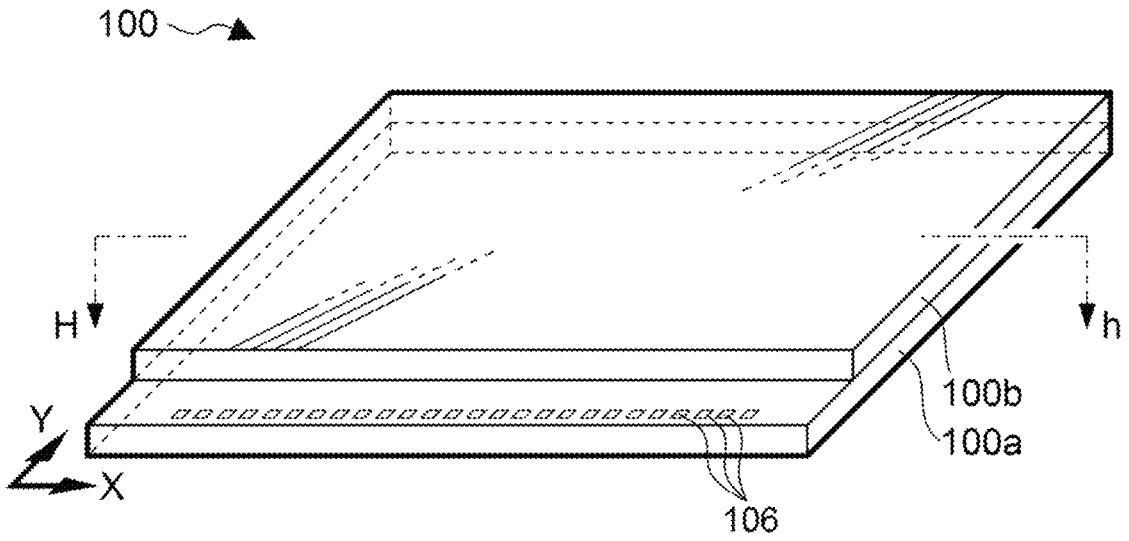
FIG. 3 is a perspective view illustrating a configuration of a liquid crystal panel in the liquid crystal projector.
Figure 4:
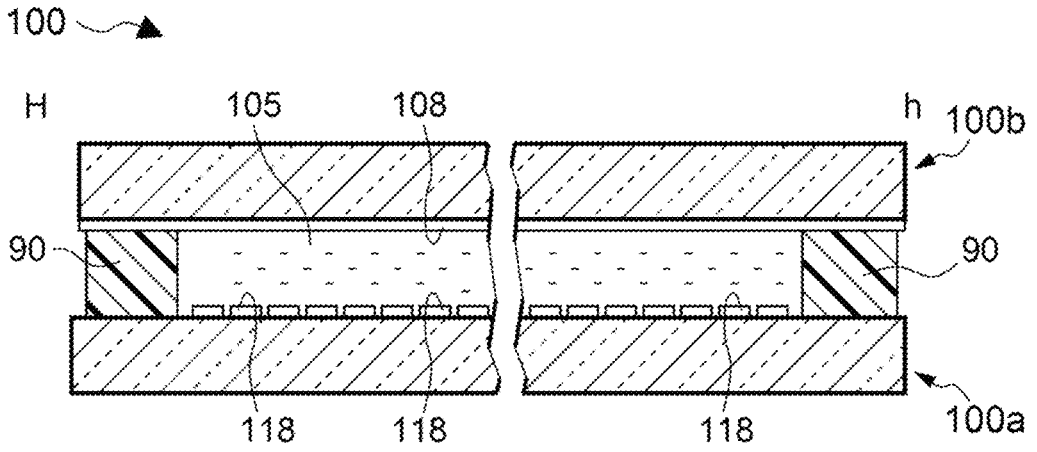
FIG. 4 is a cross-sectional view illustrating structure of the liquid crystal panel.

FIG. 3 is a diagram illustrating a main portion of the liquid crystal panel 100, and FIG. 4 is a cross-sectional view taken along a line H-h in FIG. 3.

As illustrated in these figures, the liquid crystal panel 100 has structure in which, an element substrate 100*a* provided with a pixel electrode 118, and a counter substrate 100*b* provided with a common electrode 108, while a certain gap is maintained by a seal material 90 including a spacer (not illustrated), are affixed to each other such that electrode forming surfaces oppose to each other, and liquid crystal 105 is encapsulated in this gap.

A substrate having optical transparency such as glass or quartz is used for each of the element substrate 100*a* and the counter substrate 100*b*. As illustrated in FIG. 3, one side of the element substrate 100*a* flares, with respect to the counter substrate 100*b*. A plurality of terminals 106 are provided in the flared region along an X direction. One end of an FPC board 74 is coupled to the plurality of terminals 106. Another end of the FPC board 74 is coupled to the image processing device 200, and is supplied with the various signals described above and the like.

On a surface of the element substrate 100*a* facing the counter substrate 100*b*, the pixel electrode 118 is formed by, for example, patterning a conductive layer having transparency such as ITO. Note that, ITO is an abbreviation for Indium Tin Oxide.

In addition, various elements other than the electrodes are also provided on a counter surface of the element substrate 100*a* and a counter surface of the counter substrate 100*b*, but are omitted from the figure.

Figure 5:
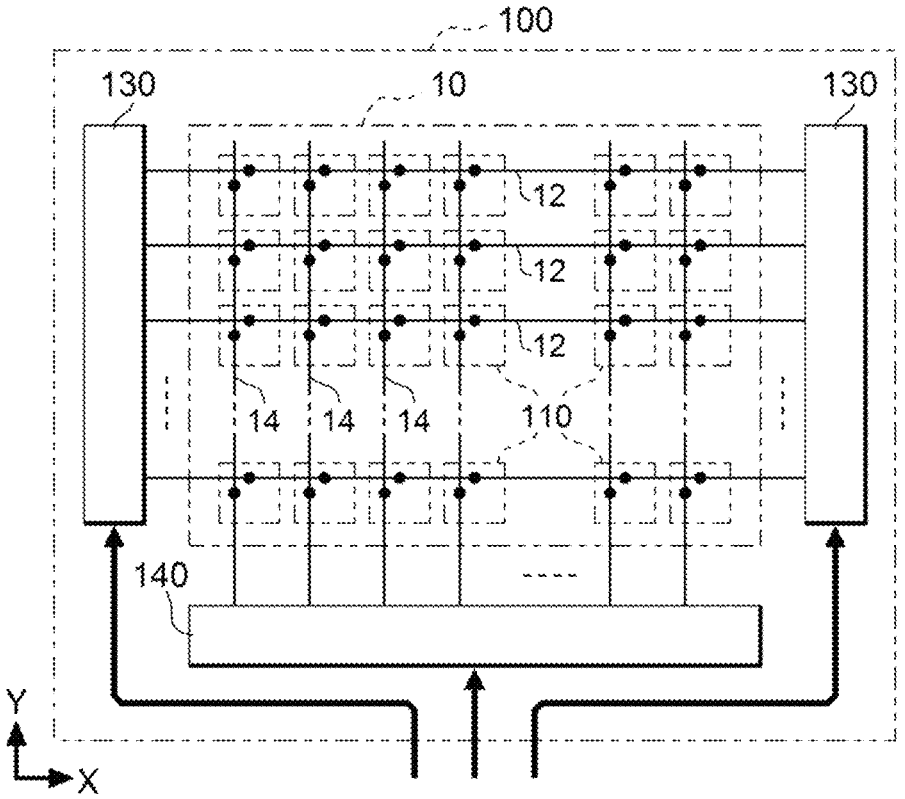
FIG. 5 is a block diagram illustrating an electrical configuration of the liquid crystal panel.

FIG. 5 is a block diagram illustrating an electrical configuration of the liquid crystal panel 100. A scanning line drive circuit 130 and a data line drive circuit 140 are provided on a circumference of a display region 10 in the liquid crystal panel 100.

In the display region 10 in the liquid crystal panel 100, pixel circuits 110 corresponding to pixels of an image to be displayed are arrayed in a matrix. More specifically, in the display region 10, a plurality of scanning lines 12 are provided extending in the X direction in the figure, and a plurality of data lines 14 extend in a Y direction, and are provided so as to be mutually and electrically insulated from the scanning lines 12. Then, the pixel circuits 110 are provided in the matrix corresponding to intersections of the plurality of scanning lines 12 and the plurality of data lines 14.

When the number of scanning lines 12 is m and the number of data lines 14 is n, the pixel circuits 110 are arrayed in the matrix in vertical m rows times horizontal n columns. Each of m and n is an integer equal to or greater than 2. As for the scanning lines 12 and the pixel circuits 110, in order to distinguish the rows in the matrix from each other, the rows may be referred to as a first, a second, a third, . . . , an (m−1)-th, and an m-th row in order from a top in the figure. Similarly, as for the data lines 14 and the pixel circuits 110, in order to distinguish the columns in the matrix from each other, the columns may be referred to as a first, a second, a third, . . . , an (n−1)-th, and an n-th column in order from a left in the figure.

In accordance with control by the display control circuit 210, the scanning line drive circuit 130 selects the scanning lines 12 one by one in an order of, for example, the first, the second. the third, . . . , the m-th row, and sets a scanning signal to the scanning line 12 selected, to an H level. Note that, the scanning line drive circuit 130 sets a scanning signal to the scanning line 12 other than the selected scanning line 12 to an L level.

The data line drive circuit 140 latches data signals corresponding to one row supplied from the circuit, of the processing circuits 220R, 220G, or 220B, of a corresponding color, and, in a period in which a scanning signal to the scanning line 12 is set to the H level, outputs the data signals to the pixel circuit 110 located on this scanning line 12 via the data line 14.

Figure 6:
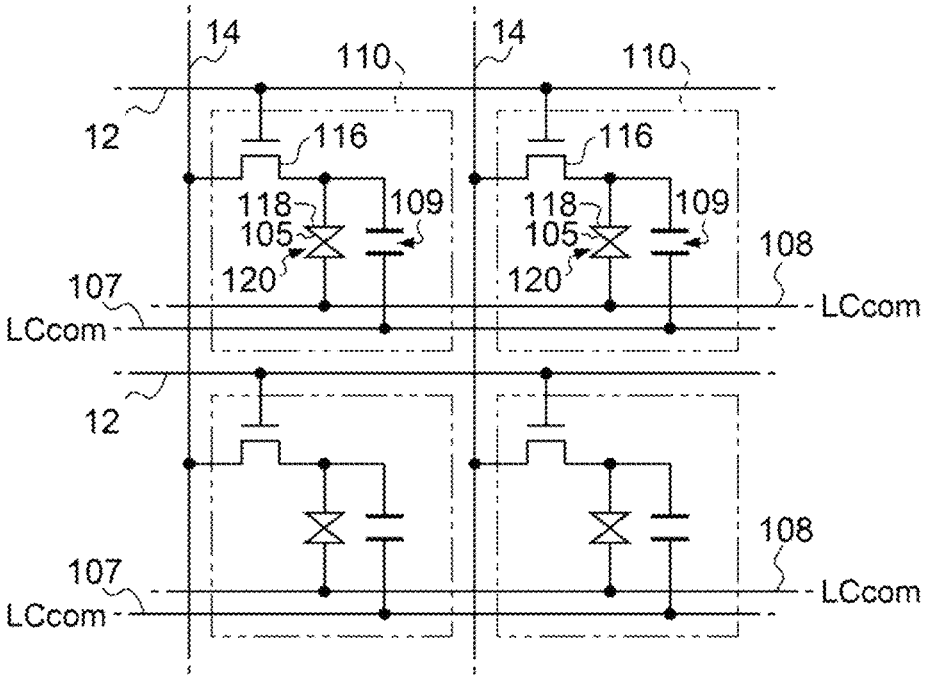
FIG. 6 is a diagram illustrating a configuration of a pixel circuit in the liquid crystal panel.

FIG. 6 is a diagram illustrating an equivalent circuit to a total of four number of the pixel circuits 110 in two rows times two columns corresponding to intersections of adjacent two number of the scanning lines 12 and adjacent two number of the data lines 14.

As illustrated in the figure, the pixel circuit 110 includes a transistor 116 and a liquid crystal element 120. The transistor 116 is, for example, an n-channel type thin film transistor. In the pixel circuit 110, a gate node of the transistor 116 is coupled to the scanning line 12, while a source node thereof is coupled to the data line 14, and a drain node thereof is coupled to the pixel electrode 118 having a substantially square shape in a plan view.

The common electrode 108 is provided in common for all the pixels so as to face the pixel electrode 118. A voltage LCcom is applied to the common electrode 108. Then, the liquid crystal 105 is sandwiched between the pixel electrode 118 and the common electrode 108 as described above. Accordingly, for each the pixel circuit 110, the liquid crystal element 120 is configured in which the liquid crystal 105 is sandwiched by the pixel electrode 118 and the common electrode 108.

In addition, a storage capacitor 109 is provided in parallel with the liquid crystal element 120. One end of the storage capacitor 109 is coupled to the pixel electrode 118, and another end is coupled to a capacitance line 107. The capacitance line 107 is applied with a voltage constant in terms of time, for example, the voltage LCcom identical to the applied voltage to the common electrode 108. The pixel circuits 110 are arrayed in the matrix in the X direction in which the scanning line 12 extends, and in the Y direction in which the data line 14 extends, thus the pixel electrodes 118 each included in the pixel circuit 110 are also arrayed in the Y direction and the X direction.

In the scanning line 12 for which the scanning signal is set to the H level, the transistor 116 of the pixel circuit 110 provided corresponding to this scanning line 12 is turned on. Since the transistor 116 is turned on, and the data line 14 and the pixel electrode 118 are brought into an electrically coupled state, a data signal supplied to the data line 14 reaches the pixel electrode 118 via the transistor 116 turned on. When the scanning line 12 is set to the L level, then the transistor 116 is turned off, but a voltage of the data signal reached to the pixel electrode 118 is retained by capacitance of the liquid crystal element 120, and the storage capacitor 109.

As is well known, in the liquid crystal element 120, alignment of liquid crystal molecules changes in accordance with an electric field generated by the pixel electrode 118 and the common electrode 108. Accordingly, the liquid crystal element 120 has a transmittance corresponding to an effective value of an applied voltage. Note that, in the present exemplary embodiment, it is assumed that a normally black mode is used in which, as an applied voltage to the liquid crystal element 120 increases, a transmittance increases.

Since operations each supplying a data signal to the pixel electrode 118 of the liquid crystal element 120 are performed for, and in an order of, the first, the second, the third, . . . , and the m-th row, a voltage corresponding to the data signal is retained for each of the liquid crystal elements 120 of the respective pixel circuits 110 arrayed in m rows times n columns. The above voltage retention results in a target transmittance of each the liquid crystal element 120, and a transmitted image of a corresponding color is generated by pixels arrayed in the m rows times n columns.

Next, a relationship among a pixel for which a gradation level is specified in the image data Vda, a pixel represented in the liquid crystal panel 100, and shift of an optical axis by the shift device 2300 will be described. Note that, the shift device 2300 shifts the optical axis in the emission direction from the dichroic prism 2112 as described above, but for convenience, this shift will be described by replacing with pixels of an image to be projected onto the screen 2120.

FIGS. 8A to 8E are diagrams for describing a relationship among display resolution, panel resolution, and pixel shift. In these figures, the display resolution refers to resolution represented by a pixel array for which gradation levels are specified in the image data Vda, that is, a pixel array of an image to be displayed. Note that, in a pixel array of display resolution in a left section in FIG. 8A, only a part of the pixel array for which gradation levels are specified in the image data Vda is extracted and illustrated.

Figure 8A:
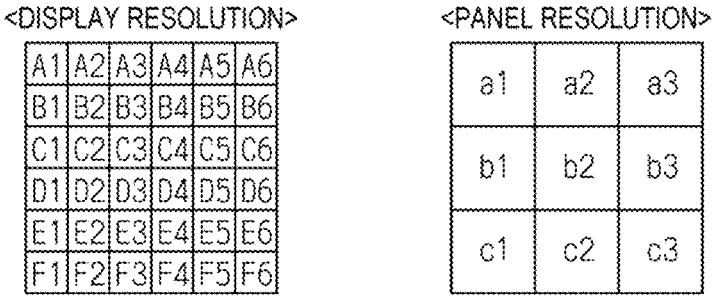
FIGS. 8A to 8E are diagrams illustrating a relationship between pixels of image data and pixels represented by the liquid crystal panel.

Additionally, the panel resolution refers to resolution represented by a pixel array of the liquid crystal panel 100. Note that, in a pixel array of panel resolution in a right section in FIG. 8A, an array corresponding to the pixel array in the left section in FIG. 8A is extracted out of the pixel array in the liquid crystal panel 100 and illustrated.

As described above, the display resolution is twice the panel resolution in the vertical direction and twice in the horizontal direction, thus in the present exemplary embodiment, one pixel in the liquid crystal panel 100 is configured to represent four pixels in the image data Vda in each field. Specifically, a position at which the one pixel in the liquid crystal panel 100 is projected onto the screen 2120 is shifted by the shift device 2300, and the four pixels in the image data Vda are represented in each field.

Here, the four fields for representing four pixels in the image data Vda are denoted as first to fourth fields in an order of time for convenience.

Figure 8B:
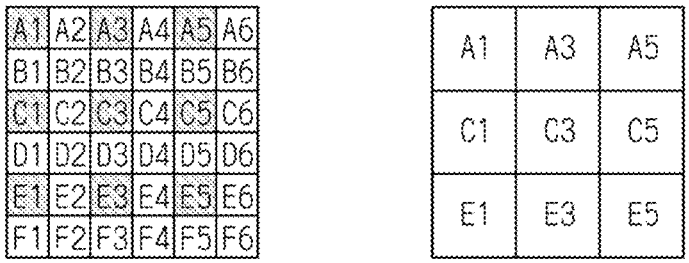
Figure 8C:
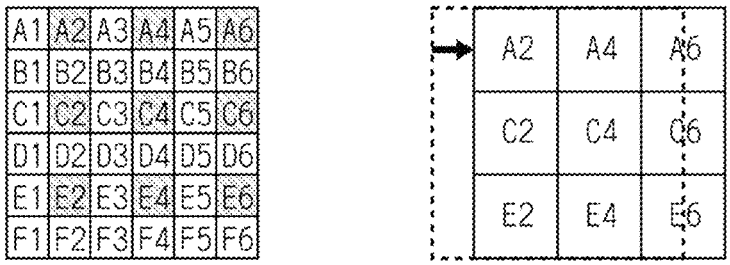

In the present exemplary embodiment, the shift device 2300 is configured to shift a pixel of the liquid crystal panel 100 projected onto the screen 2120 with respect to two axes, that is a horizontal axis and a vertical axis. Specifically, when based on a position of a pixel in the first field as illustrated in FIG. 8B, the shift device 2300, in the second field, as illustrated in FIG. 8C, shifts a pixel of the liquid crystal panel 100 projected onto the screen 2120 rightward by approximately half a length of one side of this pixel from the position in the first field indicated by a dashed line.

Figure 8D:
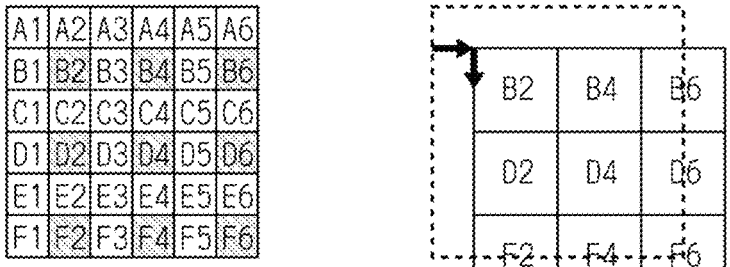

The shift device 2300, in the third field, as illustrated in FIG. 8D, shifts the pixel of the liquid crystal panel 100 being projected downward from the position in the second field by approximately half the length of the one side of this pixel.

Figure 8E:
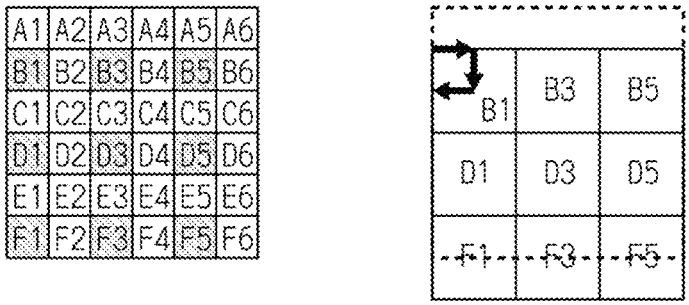

The shift device 2300, in the fourth field, as illustrated in FIG. 8E, shifts the pixel of the liquid crystal panel 100 being projected rightward from the position in the third field by approximately half the length of the one side of this pixel.

Note that, the shift device 2300 shifts, after the fourth field, in the first field of a next frame, the pixel of the liquid crystal panel 100 projected onto the screen 2120 upward from the position in the fourth field by approximately half the length of the one side of the pixel.

In addition, in FIG. 8A, for example, a pixels al of the liquid crystal panel 100 represents four pixels A1, A2, B1, and B2 that are horizontally and vertically adjacent to each other, out of pixels arrayed in 2m rows times 2n columns for which gradation levels are specified in the image data Vda.

In the first field, as illustrated in FIG. 8B, the pixel al of the liquid crystal panel 100 represents the pixel A1 at an upper left end of the four pixels adjacent to each other in the image data Vda.

In the second field, as illustrated in FIG. 8C, the pixel al of the liquid crystal panel 100 represents the pixel A2 at an upper right end of the four pixels adjacent to each other in the image data Vda.

In the third field, as illustrated in FIG. 8D, the pixel al of the liquid crystal panel 100 represents the pixel B2 at a lower right end of the four pixels adjacent to each other in the image data Vda.

In the fourth field, as illustrated in FIG. 8E, in the fourth field, the pixel al of the liquid crystal panel 100 represents the pixel B1 at a lower left end of the four pixels adjacent to each other in the image data Vda.

Here, the pixels A1, A2, B1, and B2 for which the gradation levels are specified in the image data Vda are described in relation to the pixel al in the liquid crystal panel 100, but other pixels specified in the image data Vda are also represented by the pixels in the liquid crystal panel 100, as illustrated in FIGS. 8A to 8E.

Thus, in the present exemplary embodiment, even though the resolution of the liquid crystal panel 100 is the m rows times n columns, when the first field to the fourth field are taken as one period, the pixel array of the 2m rows times 2n columns for which gradation levels are specified in the image data Vda can be represented.

Before describing a domain and correction thereof in the present exemplary embodiment, a domain and a correction thereof according to a comparative example will be described.

Figure 9A:
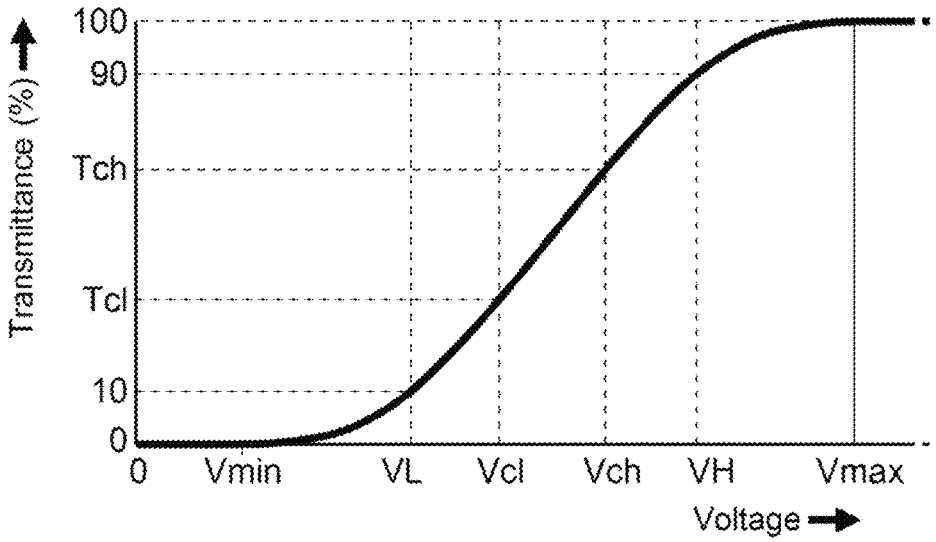
FIGS. 9A and 9B are diagrams illustrating an example of a V-T characteristic, and the like, in the liquid crystal panel.

FIG. 9A is a diagram illustrating an example of a characteristic of applied voltage and transmittance (V-T characteristic) of the liquid crystal element 120 in the normally black mode.

In the normally black mode, in a pixel for which a high gradation level is specified to increase a transmittance thereof (light pixel), an applied voltage in the liquid crystal element 120 is high. On the other hand, in a pixel for which a low gradation level is specified to decrease a transmittance thereof (dark pixel), an applied voltage in the liquid crystal element 120 is low. These light pixel and dark pixel are defined for convenience as follows.

When a voltage corresponding to a gradation level is applied to the pixel electrode 118, the light pixel is a pixel for which an applied voltage to the liquid crystal element 120 including this pixel electrode 118 exceeds VH, and the dark pixel is a pixel for which an applied voltage to the liquid crystal element 120 falls below VL. Here, there is a relationship of VH>VL, for VH and VL. In addition, when an applied voltage to the liquid crystal element 120 is the voltage VL, for example, a relative transmittance becomes 10%, and when the applied voltage is the voltage VH, for example, the relative transmittance becomes 90%. However, VL and VH may be voltages corresponding to other relative transmittances.

Figure 9B:
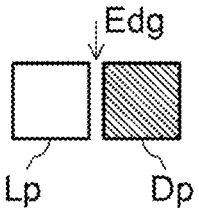

As illustrated in FIG. 9B, when a light pixels Lp and a dark pixel Dp are adjacent to each other in the liquid crystal panel 100, a voltage difference between the pixel electrodes 118 increases, and an alignment disarray or domain of liquid crystal molecules is made likely to be generated by a lateral electric field in a vicinity of a boundary Edg between the two pixels. In general, as a voltage difference between the pixel electrodes 118 increases, a degree of domain that is generated near a boundary between two adjacent pixels increases. A pixel causing a domain do not have a transmittance corresponding to a gradation level, thus becomes a factor for deteriorating display quality.

In particular, when representation is assumed in which, in continuous fields, the light pixel moves by one pixel at a time with the dark pixel as a background, in association with the movement of the light pixel, not only is a domain generated in a pixel that is supposed to change from the dark pixel to the light pixel, but the generated domain remains. As a result of this residue, reverse tilt generation regions for a plurality of light pixels are linked, and are visually recognized as a type of tailing phenomenon.

Thus, in consideration of simply suppressing display defects caused by a domain, when the light pixel changed from the dark pixel is adjacent to another dark pixel, it is supposed to be sufficient that the domain correction is performed so as to reduce a lateral electric field generated between the respective pixel electrodes 118 of this light pixel and this dark pixel.

On the other hand, as in the present exemplary embodiment, in the configuration in which a pixel of the liquid crystal panel 100 is shifted with respect to the two axes by the shift device 2300, even when an image specified in the image data Vda is a still image, that is, even when there is no change in a gradation level of a pixel when compared in previous and following frames, a gradation level changes as in a case of a video in some cases, when the pixel of the liquid crystal panel 100 is viewed. This case will be described below with reference to FIGS. 10A to 10C.

Figure 10A:
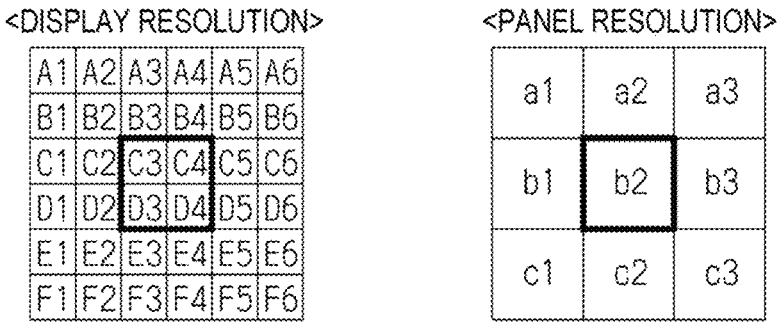
FIGS. 10A to 10C are diagrams illustrating a display example of pixels of the liquid crystal panel in each field.
Figure 10B:
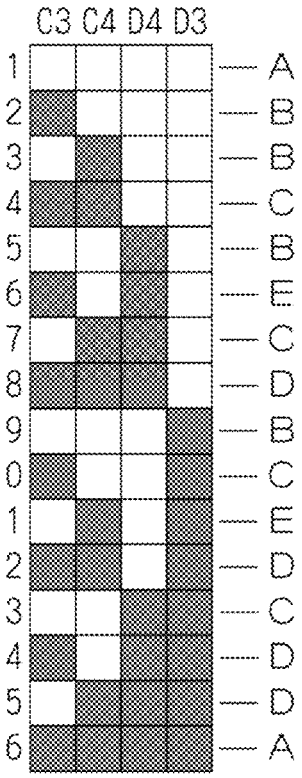
Figure 10C:
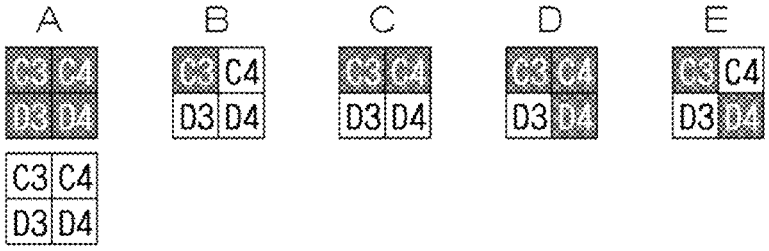

FIGS. 10A to 10C are diagrams illustrating, when four pixels for which gradation levels are specified in the image data Vda are represented by one pixel of the liquid crystal panel 100, combinations of the light pixels and the dark pixels that are possible for the one pixel in the liquid crystal panel 100, and the like.

Here, as illustrated by a thick frame in FIG. 10A, pixels C3, C4, D4, and D3 of the pixels arrayed for which gradation levels are specified in the image data Vda, and a pixel b2 of the liquid crystal panel 100 representing these four pixels are focused. Here, the number of combinations of the light pixels and the dark pixels that are possible for the pixel b2 is 16 as illustrated in FIG. 10B.

Note that, in FIG. 10B, C3, C4, D4, and D3 along a horizontal axis indicate how the pixel b2 changes in each of the first field to the fourth field, and the dark pixel is denoted by a black square, and the light pixel is denoted by a white square. In addition, when the pixel b2 in the liquid crystal panel 100 becomes other than the light pixel and the dark pixel, a domain is not generated, and thus the case is excluded from the combinations.

As illustrated in FIG. 10C, the above 16 combinations can be classified into any of the following five patterns of A, B, C, D, and E.

Specifically, the pattern A is a pattern in which the pixel b2 is fixed to either the light pixel or the dark pixel in the first field to the fourth field, and two combinations are included in the above 16 combinations.

The pattern B is a pattern in which the pixel b2 becomes the dark pixel in any one field in the first field to the fourth field, and becomes the light pixel in the remaining three fields, and four combinations are included in the above 16 combinations.

The pattern C is a pattern in which the pixel b2 becomes one of the dark pixel and the light pixel in two consecutive fields in the first field to the fourth field, and then becomes another of the dark pixel and the light pixel, and four combinations are included in the above 16 combinations.

The pattern D is a pattern in which the pixel b2 becomes the dark pixel in any three field in the first field to the fourth field, and becomes the light pixel in the remaining one field, and four combinations are included in the above 16 combinations.

The pattern E is a pattern in which the pixels b2 becomes the light pixel and the dark pixel alternately in the first field to the fourth field, and two combinations are included in the above 16 combinations.

As described above, deterioration in display quality due to a domain is likely to be generated when the light pixel changed from the dark pixel is adjacent to another dark pixel. Thus, in the liquid crystal panel 100, a case in which a pixel that belongs to any of the above five patterns is located between the light pixel and the dark pixel will be considered.

Figure 11:
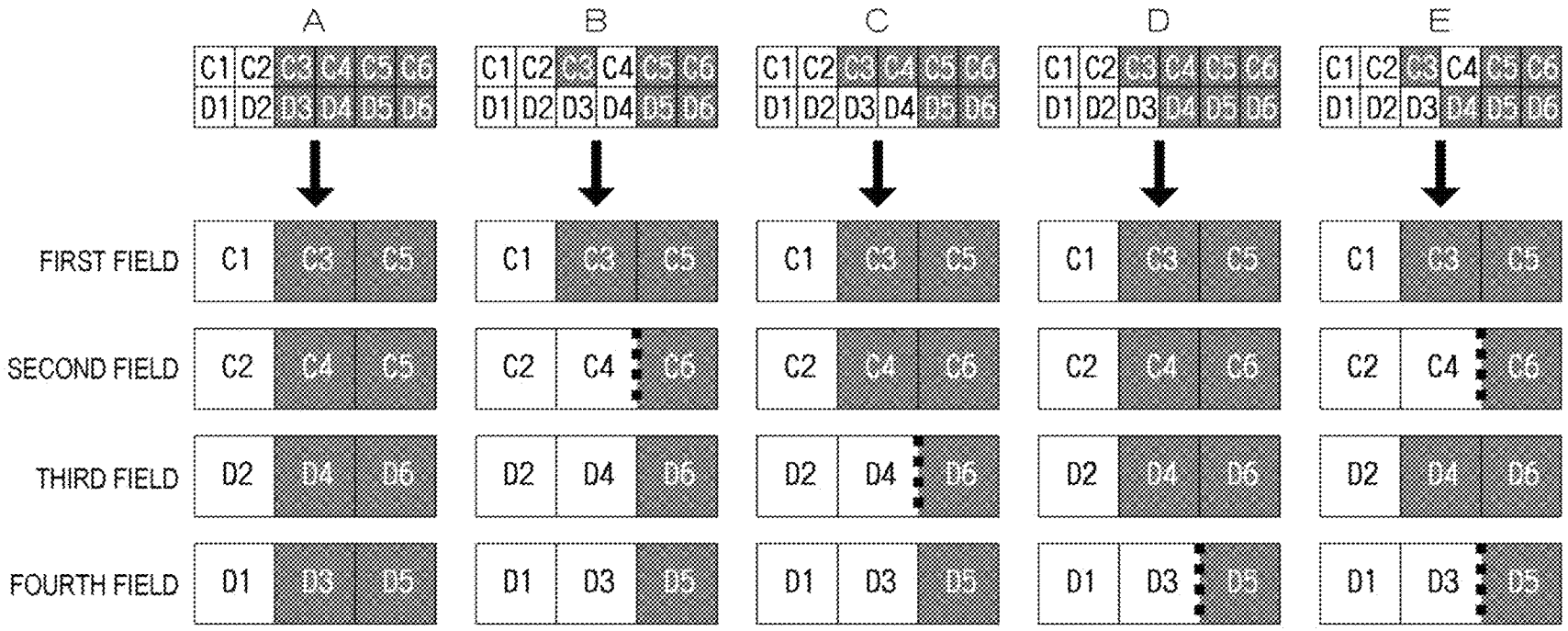
FIG. 11 is a diagram illustrating domain correction in the above display example.

FIG. 11 is a diagram illustrating change in the first field to the fourth field of each pixel belonging to the above five patterns when located between the light pixel and the dark pixel.

In the pattern A, the pixel b2 in the liquid crystal panel 100 is fixed to either the light pixel or the dark pixel over the first field to the fourth field, and thus the domain correction is not determined to be necessary.

In the pattern B, the pixel b2 becomes the dark pixel in any one field in the first field to the fourth field, and becomes the light pixel in the remaining three fields, and thus the domain correction is determined to be necessary when the pixel b2 changes from one of the light pixel and the dark pixel to another. Note that, in the pattern B in FIG. 11, an example is illustrated in which, the pixel b2 of the liquid crystal panel 100 changes from the dark pixel to the light pixel in the second field, and is adjacent to the right dark pixel, and thus the domain correction is determined to be necessary.

In the pattern C, the pixel b2 becomes one of the dark pixel and the light pixel, in two consecutive fields out of the first field to the fourth field, then becomes another of the dark pixel and the light pixel, thus the domain correction is determined to be necessary when the pixel b2 changes from the dark pixel to the light pixel. Note that, in the pattern C in FIG. 11, an example is illustrated in which, the pixel b2 changes from the dark pixel to the light pixel in the third field, and is adjacent to the right dark pixel, and thus the domain correction is determined to be necessary.

In the pattern D, the pixel b2 becomes one of the dark pixel and the light pixel, in three consecutive fields out of the first field to the fourth field, then becomes another of the dark pixel and the light pixel, thus the domain correction is determined to be necessary when the pixel b2 changes from the dark pixel to the light pixel. Note that, in the pattern D in FIG. 11, an example is illustrated in which, the pixel b2 changes from the dark pixel to the light pixel in the fourth field, and is adjacent to the right dark pixel, and thus the domain correction is determined to be necessary.

In the pattern E, since the pixel b2 becomes alternately the light pixel and the dark pixel in the first field to the fourth field, and thus the domain correction is determined to be necessary, when the pixel b2 changes from the dark pixel to the light pixel. Note that, in the pattern E in FIG. 11, an example is illustrated in which, the pixel b2 changes from the dark pixel to the light pixel in the second field and the fourth field, and is adjacent to the right dark pixel, and thus the domain correction is determined to be necessary.

In this manner, in the configuration in which the pixel of the liquid crystal panel 100 is shifted by the shift device 2300, even when an image specified in the image data Vda is a still image, since there is a case in which, when the pixel of the liquid crystal panel 100 is viewed, a gradation level may change as in a case of a video, and thus the domain correction is often determined to be necessary. On the other hand, performing the domain correction results in a display contradiction.

Thus, in the present exemplary embodiment, in a case that a certain pixel of the liquid crystal panel 100 is focused in each field from the first field to the fourth field, when this focused pixel changes from the dark pixel to the light pixel, and this focused pixel is adjacent to the dark pixel, temporary determination of performing the domain correction is made.

However, a configuration is adopted in which, when a state of this light pixel and this dark pixel for which the temporary determination of performing the domain correction is made is identical to a state before one frame, in other words, before four fields, the temporary determination of performing this domain correction is canceled, and the domain correction is not performed.

Figure 12:
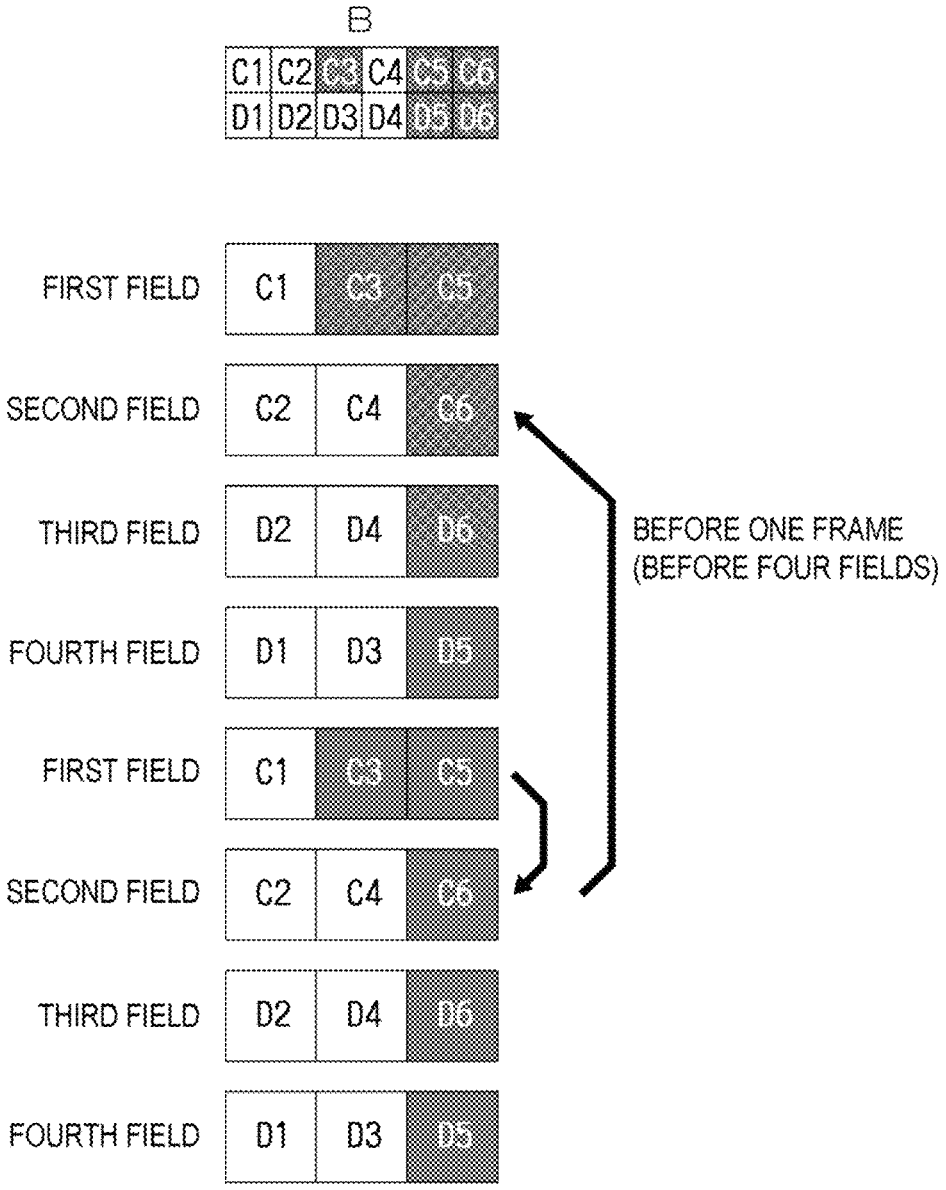
FIG. 12 is a diagram illustrating cancellation of the domain correction in the above display example.

Specifically, in the pattern B in FIG. 11, in the second field, the pixels b2 of the liquid crystal panel 100 representing the pixels C4 in the image data Vda changes from the dark pixel to the light pixel, and is adjacent to the dark pixel of the pixel b3 of the liquid crystal panel 100 representing a pixel C6 in the image data Vda, thus, temporary determination of performing the domain correction is made. However, as illustrated in FIG. 12, a configuration is adopted in which, when the pixel b2 and the pixel b3 are also the same light pixel and dark pixel before four fields, respectively, the temporary determination of performing this domain correction is canceled, and the domain correction is not performed.

Note that, when the state of this light pixel and this dark pixel for which the temporary determination of performing the domain correction is made is a different state also before four fields, the temporary determination of performing this domain correction is maintained, and the domain correction is performed.

Here, for the domain correction, it is sufficient to reduce a lateral electric field of the light pixel and the dark pixel, thus the following three aspects are conceivable. In other words, a first aspect in which an applied voltage to the liquid crystal element 120 of the light pixel is brought close to an applied voltage to the liquid crystal element 120 of the dark pixel, a second aspect in which an applied voltage to the liquid crystal element 120 of the dark pixel is brought close to an applied voltage to the liquid crystal element 120 of the light pixel, and a third aspect in which both an applied voltage to the liquid crystal element 120 of the dark pixel and an applied voltage to the liquid crystal element 120 of the light pixel are brought close to each other, are conceivable.

In the present exemplary embodiment, a description is given by adopting the first aspect in the sense of simplifying the description. When the first aspect is specifically described, in FIGS. 9A and 9B, in the correction, a transmittance of the light pixel is replaced with a gradation level corresponding to Tch, and an applied voltage to the liquid crystal element 120 is set to Vch, so as to be brought close to an applied voltage to the liquid crystal element 120 of the dark pixel.

Note that, when the second aspect is adopted, in the correction, a transmittance of the dark pixel is replaced with a gradation level corresponding to Tcl, and an applied voltage to the liquid crystal element 120 is set to Vcl, so as to be brought close to an applied voltage to the liquid crystal element 120 of the light pixel. Furthermore, when the third aspect is adopted, in the correction, a transmittance of the light pixel is replaced with a gradation level corresponding to Tch, and a transmittance of the dark pixel is replaced with a gradation level corresponding to Tcl.

Figure 7:
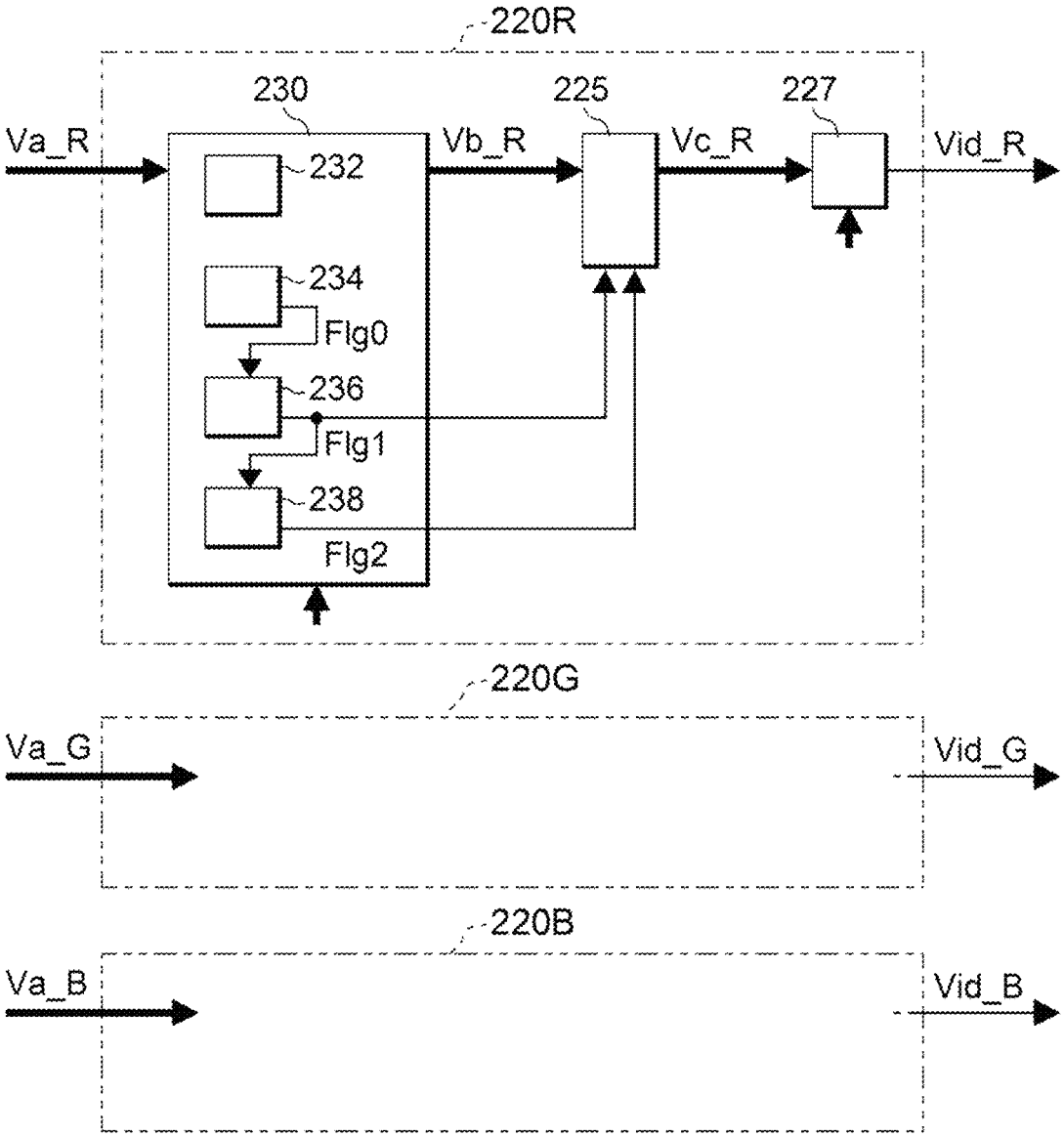
FIG. 7 is a block diagram illustrating a configuration of a processing circuit in the liquid crystal projector.

FIG. 7 is a block diagram illustrating a configuration of the processing circuits 220R, 220G, and 220B.

Note that, a configuration is common for the processing circuits 220R, 220G, and 220B, thus the processing circuit 200R will be described here as an example.

The image data Va_R obtained by decomposing the image data Vda from the higher device by using the display control circuit 210 is supplied to the processing circuit 220R. The image data Va_R specifies gradation levels of R that correspond to a field in an order of pixels in a first row first column to a first row n-th column, a second row first column to a second row n-th column, a third row first column to a third row n-th column, . . . , an m-th row first column to an m-th row n-th column in the array of the liquid crystal panel 100.

As illustrated in FIG. 7, the processing circuit 220R includes a determining unit 230, a correction unit 225, and a D/A converting unit 227, and the determining unit 230 includes a storage unit 232, a first determining unit 234, a second determining unit 236, and a third determining unit 238.

After accumulating the image data Va_R supplied from the display control circuit 210, the storage unit 232 reads the image data and outputs as image data Vb_R. Note that, a pixel for which a gradation level is specified in the image data Vb_R is defined as a focused pixel.

The first determining unit 234 determines whether the focused pixel for which a gradation level is specified in the image data Vb_R changes from the dark pixel to the light pixel or not. Specifically, the first determining unit 234 determines whether or not the gradation level (of the focused pixel) specified in the image data Vb_R exceeds a gradation level corresponding to the light pixel, and a gradation level specified in the image data Vb_R before one field stored in the storage unit 232 falls below a gradation level corresponding to the dark pixel. Note that, when determining that the focused pixel changes from the dark pixel to the light pixel, the first determining unit 234 outputs a flag Flg0.

When the flag Flg0 is outputted from the first determining unit 234, the second determining unit 236 determines as follows. In other words, the second determining unit 236 determines whether or not a pixel adjacent to the focused pixel for which the gradation level is specified in the image data Vb_R is the dark pixel. Specifically, the second determining unit 236, for a gradation level of a pixel adjacent to this focused pixel horizontally or vertically, reads and acquires, for example, the image data Vb_R stored in the storage unit 232, and determines whether or not the acquired gradation level specified in the image data Vb_R falls below a gradation level corresponding to the dark pixel.

When determining that the pixel adjacent to the focused pixel is the dark pixel, the second determining unit 236 outputs a flag Flg1. Note that, the determination by the second determining unit 236 is performed when the flag Flg0 is outputted from the first determining unit 234. Thus, the case in which the flag Flg1 is outputted is the case in which the first determining unit 234 determines that the focused pixel changes from the dark pixel to the light pixel, and the second determining unit 236 determines that the pixel adjacent to the focused pixel is the dark pixel. That is, the case in which the flag Flg1 is outputted is a case in which temporary determination that the domain correction is necessary is to be made.

When the flag Flg1 is outputted from the second determining unit 236, the third determining unit 238 determines as follows. In other words, the third determining unit 238 determines, for the focused pixel, whether or not each of the gradation level (in a current field) specified in the image data Vb_R and the gradation level of the pixel adjacent to this focused pixel and determined to be the dark pixel is identical to a gradation level before four fields.

Specifically, firstly, the third determining unit 238 reads and acquires, from the storage unit 232, gradation data specified before four fields for the focused pixel, and gradation data specified before four fields for the pixel adjacent to this focused pixel and determined to be the dark pixel. Secondly, the third determining unit 238 determines, for the focused pixel, whether or not the gradation level specified in the image data Vb_R is identical to the acquired gradation level before four fields, and further, determines whether or not the gradation level of the pixel adjacent to this focused pixel and determined to be the dark pixel is identical to the acquired gradation level before four fields for the focused pixel.

The third determining unit 238 outputs a flag Flg2, when each of the gradation level of the focused pixel in the current field, and the gradation level of the pixel adjacent to this focused pixel and determined to be the dark pixel is identical to the gradation level before four fields. In other words, the case in which the flag Flg2 is outputted is a case in which temporary determination of the domain correction is to be canceled.

When the flag Flg1 is outputted and the flag Flg2 is not outputted, that is, when temporary determination that the domain correction is necessary is not canceled, the correction unit 225 performs the domain correction. Specifically, in this case, the correction unit 225 replaces the gradation level specified in the image data Vb_R with a gradation level corresponding to the transmittance Tch, and outputs the gradation level as image data Vc_R.

On the other hand, when the flag Flg1 is not outputted, or when both the flags Flg1 and Flg2 are outputted, the correction unit 225 does not perform the domain correction. Note that, the case in which the flag Flg1 is not outputted is a case in which temporary determination that the domain correction is necessary is not to be made, and the case in which both the flags Flg1 and Flg2 are outputted is the case in which temporary determination that the domain correction is necessary is to be canceled.

In this case, the correction unit 225 outputs the gradation level specified in the image data Vb_R as is as the image data Vc_R without changing.

The D/A converting unit 227 converts the image data Vc_R being digital to a data signal Vid_R having an analog voltage with a polarity specified by the display control circuit 210, and supplies the signal to the liquid crystal panel 100R.

Note that, the processing circuit 220R has been described here as an example, but the processing circuits 220G and 200B each have a similar configuration to that of the processing circuit 220R.

In other words, the processing circuit 220G processes the image data Va_G corresponding to G, converts to the data signal Vid_G, and supplies the data signal to the liquid crystal panel 100G, and the processing circuit 220B processes the image data Va_B corresponding to B, converts to the data signal Vid_B, and supplies the data signal to the liquid crystal panel 100B.

In the comparison example, the domain correction is performed when the focused pixel changes from the dark pixel to the light pixel, and the pixel adjacent to the focused pixel is the dark pixel. Compared to this, in the present exemplary embodiment, in the above-described case, and when the gradation level of each of this focused pixel and the adjacent dark pixel is identical to that before four fields, the domain correction is not performed.

Accordingly, in the present exemplary embodiment, the number of times that the domain correction is performed is reduced compared to the comparative example, thus a display contradiction is suppressed.

Even when an image represented in the image data Vda is a still image, in the liquid crystal panel 100, there may be a pixel for which a gradation level changes in four fields. However, when an image represented in the image data Vda is a still image, in the present exemplary embodiment, in the liquid crystal panel 100, a gradation level changes in one pixel at most, and thus even if a domain occurs, the domain is unlikely to be visually recognized as deterioration in display quality.

In addition, in the comparison example, when an image represented in the image data Vda is a still image, the domain correction is performed particularly at a boundary between the light pixel and the dark pixel, thus a display contradiction is made likely to be visually recognized. Compared to this, in the present exemplary embodiment, in the case in which an image represented in the image data Vda is a still image, the domain correction is not performed even at a boundary between the light pixel and the dark pixel, thus a display contradiction does not occur.

Thus, according to the present exemplary embodiment, as compared to the comparative example, the domain correction is not performed in a portion that is easily and visually recognized, a display contradiction does not occur, thus improvement in image quality can be expected.

Note that, in the exemplary embodiment described above, the configuration is adopted in which temporary determination of performing the domain correction is to be canceled when the gradation level of each of the focused pixel and the adjacent dark pixel is identical to the gradation level before four fields, but, for example, when a position of a pixel of the liquid crystal panel 100 is shifted by the shift device over three locations, it is sufficient to adopt a configuration in which temporary determination is to be canceled when a gradation level of each of the focused pixel and the adjacent dark pixel is identical to a gradation level before three fields.

Additionally, in the exemplary embodiment described above, the configuration is adopted in which, temporary determination of performing the domain correction is to be canceled when the gradation level of each of the focused pixel and the adjacent dark pixel is identical to the gradation level before four fields, but a configuration may also be adopted in which, temporary determination of performing the domain correction is to be canceled, when, a gradation level of a pixel corresponding to each of a focused pixel and an adjacent dark pixel for the liquid crystal panel 100, of pixels of an image represented in the image data Vda, is compared with that in a previous frame and is identical to each other (including a case in which a difference between gradation levels is within a threshold value and the gradation levels can be regarded to be identical), temporary determination of performing the domain correction is to be canceled.

Since the image data Vda supplied from the higher device is once accumulated in the display control circuit 210, although not particularly illustrated, the third determining unit 238 may be relocated to the display control circuit 210, and when the flag Flg1 is outputted, this third determining unit 238 may analyze the image data Vda accumulated in the display control circuit 210 to output the flag Flg2. In other words, this third determining unit 238 may be configured to compare, of the pixels of the image represented in the image data Vda accumulated in the display control circuit 210, the gradation level of the pixel corresponding to each of the focused pixel and the adjacent dark pixel in the liquid crystal panel 100 with that in the previous frame, and determine whether the gradation levels are identical or not, and when determining as identical, output the flag Flg2.

Alternatively, it is also possible that the display control circuit 210, the processing circuit 220R, and the like are not distinguished, and grouped together as a single element.

In addition, a configuration may be adopted in which, in a case in which the image data Vda is analyzed and a part or an entirety of a full screen is determined to be a still image, and a region determined to be a still image is represented by the liquid crystal panel 100, even when temporary determination of performing the domain correction is made, this temporary determination is forcibly canceled, and the domain correction is not to be performed.

In addition, a configuration may also be adopted in which, in a case of so-called double speed driving, specifically, when an image represented in the image data Vda is repeatedly displayed in the liquid crystal panel 100 in a first field to an N-th field, in an initial first field, temporary determination of whether to perform the domain correction or not is made, and then whether to cancel the temporary determination or not is determined.

In the double speed driving, in the second field to the N-th field, an identical image is displayed on the liquid crystal panel 100, and a substantially static image is displayed, thus, a configuration may be adopted in which, even when temporary determination of performing the domain correction is made, this temporary determination is forcibly canceled, and the domain correction is not to be performed.

Note that, the second determining unit 236 is an example of the temporary determining unit, and the third determining unit 238 is an example of the cancellation unit. R (red) is an example of a first color, and the liquid crystal panel 100R is an example of a first liquid crystal panel. G (green) is an example of a second color, and the liquid crystal panel 100G is an example of a second liquid crystal panel. B (blue) is an example of a third color, and the liquid crystal panel 100B is an example of a third liquid crystal panel.

Additionally, although in the exemplary embodiment, the description has been given using the normally black mode, a normally white mode may also be used. In addition, the liquid crystal panels 100R, 100G, and 100B are transmission type, but may also be reflective type.

What is claimed is:

1. An image processing device displaying image data of an image, which has predetermined resolution specified with the image data, over a plurality of fields by using a liquid crystal panel having resolution smaller than the predetermined resolution, the image processing device comprising:

circuitry configured to:

determine, based on a gradation level specified for one pixel of the liquid crystal panel and a gradation level specified for another pixel adjacent to the one pixel in one field, whether to perform correction of the gradation level of at least one of the one pixel and the other pixel, cancel performing the correction in response to determining that the gradation level specified for the one pixel and the gradation level specified for the other pixel are identical to gradation levels of the one pixel and the other pixel in a field that precedes, by a plurality of fields, the one field, and perform the correction in response to determining that the gradation level specified for the one pixel and the gradation level specified for the other pixel are not identical to the gradation levels in the field that precedes, by the plurality of fields, the one field.

2. The image processing device according to claim 1, wherein the circuitry analyzes a gradation level of a pixel corresponding to the one pixel and a gradation level of a pixel corresponding to the other pixel, among pixels constituting the image having the predetermined resolution, and when the gradation level is determined to be unchanged, cancels the temporary determination.

3. A liquid crystal projector comprising:

the image processing device according to claim 1;

a first liquid crystal panel configured to display the one pixel and the other pixel; and a shift device configured to shift, over three or more fields, a position of a pixel displayed in the first liquid crystal panel.

4. The liquid crystal projector according to claim 3, wherein the first liquid crystal panel displays an image corresponding to a first color, the liquid crystal projector comprising:

a second liquid crystal panel for displaying an image corresponding to a second color that differs from the first color; and a third liquid crystal panel for displaying an image corresponding to a third color that differs from the first color and the second color, and wherein the shift device shifts a position of a synthesized image that is synthesized from the image of the first color by the first liquid crystal panel, the image of the second color by the second liquid crystal panel, and the image of the third color by the third liquid crystal panel.

* * * * *